US009089853B2

(12) United States Patent
Tsugawa et al.

(10) Patent No.: US 9,089,853 B2
(45) Date of Patent: Jul. 28, 2015

(54) VERTICAL CENTRIFUGAL SEPARATION APPARATUS SUPPORTABLE IN MULTIPLE OVERTURN POSITIONS

(75) Inventors: Tetsuya Tsugawa, Tokyo (JP); Kokichi Dohi, Tokyo (JP); Atsushi Sada, Tokyo (JP)

(73) Assignee: Tomoe Engineering Co., Ltd., Tokyo (JP)

( * ) Notice: Subject to any disclaimer, the term of this patent is extended or adjusted under 35 U.S.C. 154(b) by 850 days.

(21) Appl. No.: 13/387,822

(22) PCT Filed: Dec. 25, 2009

(86) PCT No.: PCT/JP2009/007257

§ 371 (c)(1),
(2), (4) Date: Mar. 13, 2012

(87) PCT Pub. No.: WO2011/013186

PCT Pub. Date: Feb. 3, 2011

(65) Prior Publication Data

US 2012/0165177 A1 Jun. 28, 2012

(30) Foreign Application Priority Data

Jul. 31, 2009 (JP) ..... 2009-178754

(51) Int. Cl.
*B04B 11/04* (2006.01)
*B04B 7/04* (2006.01)

(52) U.S. Cl.
CPC .. *B04B 11/04* (2013.01); *B04B 7/04* (2013.01)

(58) Field of Classification Search
CPC .... B04B 1/20; B04B 1/08; B04B 2001/2041; B04B 2001/2066; B04B 7/04; B04B 11/04
USPC ..... 494/47, 53, 54, 37; 210/380.1
See application file for complete search history.

(56) References Cited

U.S. PATENT DOCUMENTS 3,092,579 A * 6/1963 Moretti ..... 210/370
5,364,335 A * 11/1994 Franzen et al. ..... 494/15

(Continued)

FOREIGN PATENT DOCUMENTS

JP 61-220750 10/1986
JP 7-163908 6/1995

(Continued)

OTHER PUBLICATIONS

International Preliminary Report on Patentability issued Feb. 9, 2012 in International (PCT) Application No. PCT/JP2009/007257.

(Continued)

*Primary Examiner* — Charles Cooley
(74) *Attorney, Agent, or Firm* — Wenderoth, Lind & Ponack, L.L.P.

(57) ABSTRACT

To provide a vertical centrifugal separation apparatus which recovers a centrifuged liquid with a reduced loss and is suitable for when a target is the centrifuged liquid, and a method of recovering the centrifuged liquid. In performing centrifugation, the liquid to be processed is supplied from a lower portion of a cylindrical rotational tube which rotates about a vertical axis, and the centrifuged liquid is discharged and recovered from an upper portion of the cylindrical rotational tube. When the centrifugation is stopped for cleaning the cylindrical rotational tube, for example, the cylindrical rotational tube is set to a first overturn position to recover the remaining centrifuged liquid, and then the cylindrical rotational tube is set to a second overturn position to pull the tube out of the casing. Such a structure allows the recovery of the centrifuged liquid as the target with a reduced loss and without waste.

7 Claims, 11 Drawing Sheets

(56) References Cited

U.S. PATENT DOCUMENTS

| | | | | |
|---|---|---|---|---|
| 5,494,579 | A * | 2/1996 | Robatel et al. | 210/380.1 |
| 9,005,097 | B2 * | 4/2015 | Feng et al. | 494/27 |
| 2011/0301013 | A1 * | 12/2011 | Feng et al. | 494/27 |
| 2012/0165177 | A1 * | 6/2012 | Tsugawa et al. | 494/37 |
| 2012/0267303 | A1 * | 10/2012 | Oldeback et al. | 210/374 |

FOREIGN PATENT DOCUMENTS

| | | | |
|---|---|---|---|
| JP | 9-131577 | | 5/1997 |
| JP | 2004-049013 | | 2/2004 |
| JP | 2005-013783 | | 1/2005 |
| JP | 2008-054531 | | 2/2008 |
| JP | 2011031152 | A * | 2/2011 |
| JP | 2012007634 | A * | 1/2012 |
| JP | 2012250201 | A * | 12/2012 |

OTHER PUBLICATIONS

International Search Report issued Apr. 20, 2010 in International (PCT) Application No. PCT/JP2009/007257.

* cited by examiner

VERTICAL CENTRIFUGAL SEPARATION APPARATUS SUPPORTABLE IN MULTIPLE OVERTURN POSITIONS

TECHNICAL FIELD

The present invention relates to a vertical centrifugal separation apparatus and a method of recovering a centrifuged liquid, and more particularly, to a vertical centrifugal separation apparatus suitable for centrifugation when a target is a centrifuged liquid and to a method of recovering the centrifuged liquid.

BACKGROUND ART

Centrifugal separation apparatuses are a type of apparatus which supplies a liquid to be processed containing solid matter into a rotating bowl and gives a centrifugal force to the liquid to be processed to allow separation thereof such as solid-liquid separation, liquid-liquid separation, and solid-liquid-liquid separation depending on the purpose. The centrifugal separation apparatus is widely used in various industrial fields without limitation.

The centrifugal separation apparatuses include vertical centrifugal separation apparatuses in which a bowl is rotated about a vertical axis as a rotation axis and horizontal centrifugal separation apparatuses in which a bowl is rotated about a horizontal axis as a rotation axis. The vertical centrifugal separation apparatus is applicable, for example in drug and chemical fields, due to the structure of the apparatus in which a casing accommodating the bowl has higher air tightness than in the horizontal centrifugal separation apparatus. The vertical centrifugal separation apparatus, however, is inconvenient in performing cleaning operation of the bowl.

Patent Document 1 has disclosed a vertical centrifugal separation apparatus in which it is easy to perform operation of discharging solid matter from a bowl which is a cylindrical rotational tube. The vertical centrifugal separation apparatus requires wide space above the apparatus in removing the bowl from the casing in order to discharge solid matter. It is thus difficult to remove the bowl in some of the installation places of the apparatus. In the vertical centrifugal separation apparatus disclosed in Patent Document 1, the casing accommodating the bowl is rotatable to at least 90 degrees such that the casing is overturned to a horizontal level to pull out the bowl in a horizontal direction.

In this manner, the vertical centrifugal separation apparatus disclosed in Patent Document 1 has the structure in which the bowl can be easily pulled out. Thus, the apparatus can be installed in limited space such as a clean room and a sterile room and can be used preferably in food, drug, medical item, and biotechnology-related fields.

For example when a liquid (centrifuged liquid) centrifuged through centrifugation is a target, the liquid remaining in the bowl represents a loss each time the bowl is pulled out of the casing in the vertical centrifugal separation apparatus disclosed in Patent Document 1, although this is not recognized as a problem when a target is centrifuged solid matter. For example, in the food, drug, medical item, and biotechnology-related fields, the manufacturing unit price or the cost of the centrifuged liquid may be significantly high. In such a case, there is a demand to recover not only the centrifuged liquid obtained in performing centrifugation but also the liquid remaining in the bowl as much as possible when the centrifugation is stopped.

CITATION LIST

Patent Literature

PTL 1: Japanese Patent Laid-Open No. 1986-220750

SUMMARY OF INVENTION

Technical Problem

The present invention has been made in view of the problem mentioned above as an example, and it is an object of the present invention to provide a vertical centrifugal separation apparatus which recovers a centrifuged liquid with a reduced loss and is suitable for when a target is the centrifuged liquid, and a method of recovering the centrifuged liquid.

Solution to Problem

According to an aspect, the present invention provides a vertical centrifugal separation apparatus including a cylindrical rotational tube which has a supply port for a liquid to be processed formed on a lower side, has a discharge port for a centrifuged liquid formed on an upper side, and is rotated about a vertical axis in performing centrifugation, a casing which accommodates the cylindrical rotational tube such that the tube is rotatable about the vertical axis, and a support apparatus which supports the casing and the cylindrical rotational tube such that the casing and the tube are overturned together, wherein the support apparatus can be set to a first overturn position in which a centrifuged liquid remaining in the cylindrical rotational tube is recovered after the centrifugation is completed and a second overturn position in which the cylindrical rotational tube is pulled out of the casing after the remaining centrifuged liquid is recovered.

Preferably, the vertical centrifugal separation apparatus further includes a drop prevention apparatus which fixes an upper portion of the cylindrical rotational tube and the casing at least when the first overturn position is set. In this case, the drop prevention apparatus includes a barrel portion support member which has a support surface supporting a barrel portion of the cylindrical rotational tube set to the overturn position in the casing and sliding the barrel portion of the cylindrical rotational tube pulled out of the casing, and an L-shaped lock portion which is formed in an end portion of the barrel portion support member and locks an upper end surface of the cylindrical rotational tube.

Preferably, the first overturn position in which the centrifuged liquid remaining in the cylindrical rotational tube is recovered is a position inclined such that the upper portion of the cylindrical rotational tube is lower than at least a horizontal level. The first overturn position is a position at which the cylindrical rotational tube is rotated at least 120 degrees.

Preferably, the vertical centrifugal separation apparatus further includes a self-sealing apparatus which closes the supply port for the liquid to be processed when the rotation of the cylindrical rotational tube about the vertical axis is stopped. In this case, the self-sealing apparatus preferably includes a supply hole for the liquid to be processed and a close member which covers the supply hole from the outside to close the hole, the hole being provided in a circumferential direction in a lower portion of the cylindrical rotational tube and passing through the cylindrical rotational tube in a diameter direction, and wherein the close member expands or moves outward to open the supply hole by the action of a centrifugal force when the cylindrical rotational tube is rotated in performing the centrifugation.

While the vertical centrifugal separation apparatus can be used in various industrial fields without limitation, the apparatus is preferably used in fields in which the manufacturing unit price or the cost is likely to be high such as food, drug, medical item, and biotechnology-related fields. Among others, the use in the field of genetic recombination is beneficial. As an application in the field of genetic recombination, it is preferable to centrifuge genetically recombined microbes and a liquid containing a genetically recombined material produced or secreted by the microbes.

According to another aspect, the present invention provides a method of recovering a centrifuged liquid, including the step of supplying a liquid to be processed from a lower portion of a cylindrical rotational tube which rotates about a vertical axis and discharging and recovering the centrifuged liquid from an upper portion of the cylindrical rotational tube, the step of stopping the rotation about the vertical axis and stopping the supply of the liquid to be processed, the step of setting the cylindrical rotational tube to a first overturn position to recover a remaining centrifuged liquid, and the step of setting the cylindrical rotational tube to a second overturn position to pull the cylindrical rotational tube out of the casing after the recovery of the remaining centrifuged liquid.

Advantageous Effects of Invention

In the vertical centrifugal separation apparatus according to the present invention, the liquid to be processed is supplied from the lower portion of the cylindrical rotational tube which rotates about the vertical axis, and the centrifuged liquid is discharged and recovered from the upper portion of the cylindrical rotational tube in performing centrifugation. When the centrifugation is stopped for cleaning the cylindrical rotational tube, for example, the cylindrical rotational tube is set to a first overturn position to recover the remaining centrifuged liquid, and then the cylindrical rotational tube is set to a second overturn position to pull the tube out of the casing. With such a structure, the vertical centrifugal separation apparatus according to the present invention can recover the centrifuged liquid as the target with a reduced loss and without waste.

REFERENCE SIGNS LIST

1 VERTICAL CENTRIFUGAL SEPARATION APPARATUS
2 BOWL
3 CASING
4 DRIVING MOTOR
5 SUPPORT APPARATUS

DETAILED DESCRIPTION OF THE INVENTION

A vertical centrifugal separation apparatus according to a preferred embodiment of the present invention will hereinafter be described in detail with reference to the accompanying drawings. However, the technical scope of the present invention should not be construed limitedly by the embodiment described below.

Figure 1:
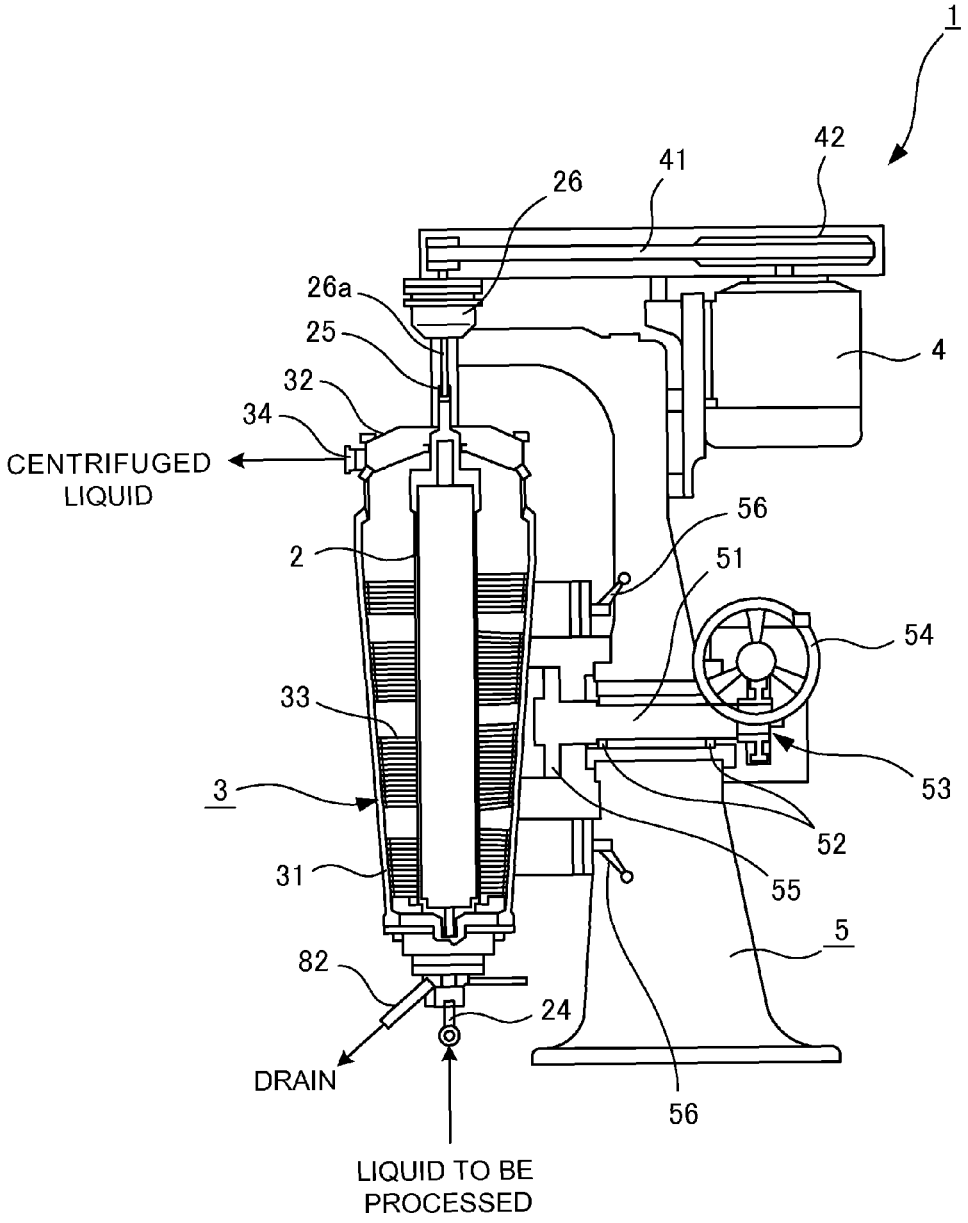
FIG. 1 is a longitudinal section view showing a vertical centrifugal separation apparatus according to a preferred embodiment of the present invention.
Figure 2:
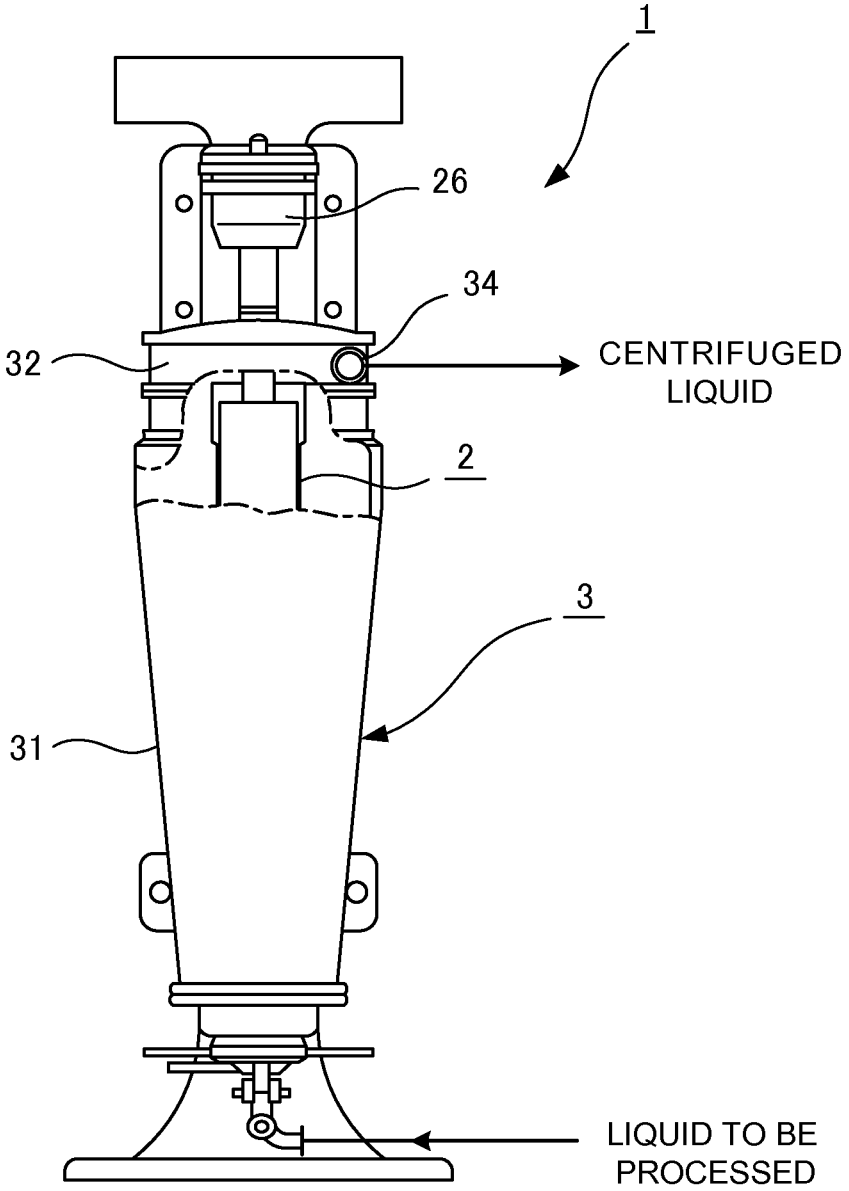
FIG. 2 is a front view showing the vertical centrifugal separation apparatus.
Figure 3A:
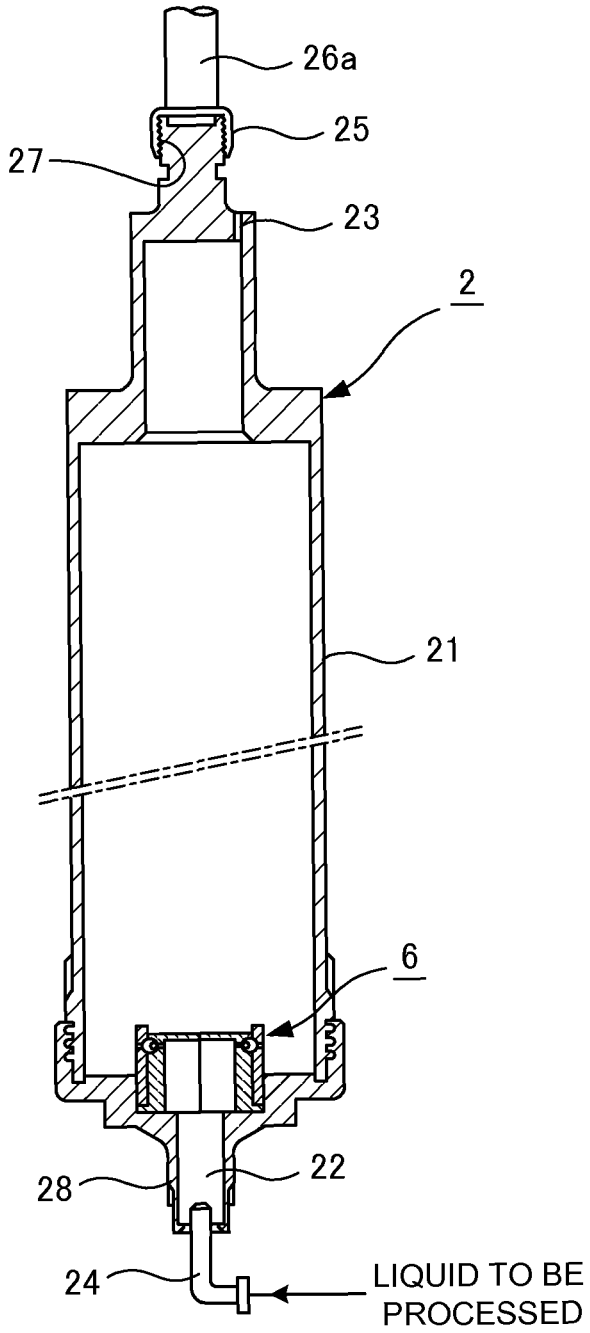
FIG. 3A is a longitudinal section view showing a bowl included in the vertical centrifugal separation apparatus.
Figure 4:
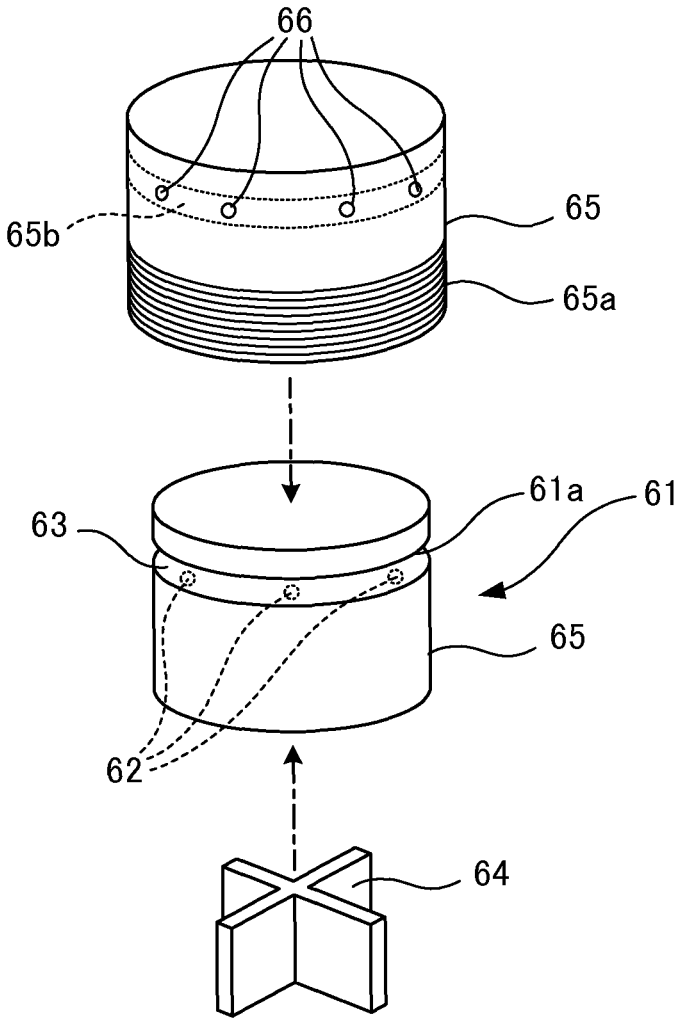
FIG. 4 is a perspective view showing a self-sealing apparatus included in the vertical centrifugal separation apparatus.
Figure 5:
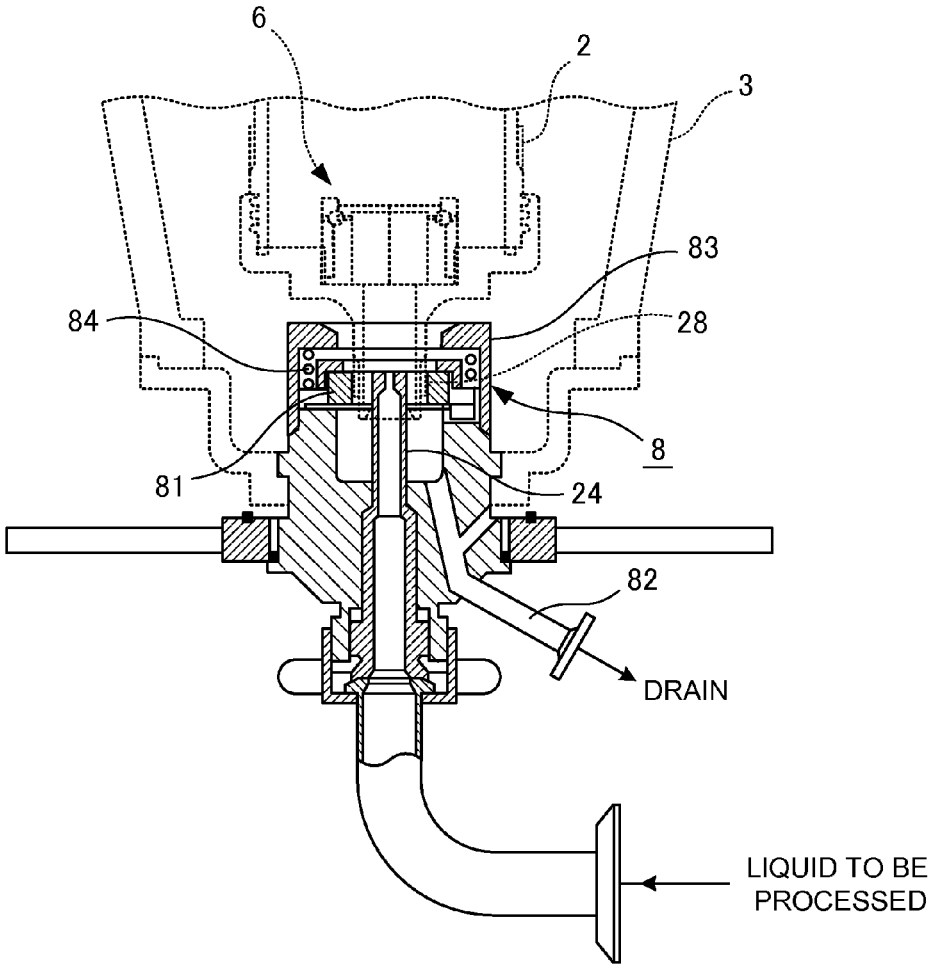
FIG. 5 is a longitudinal section view showing a lower bearing included in the vertical centrifugal separation apparatus.

FIG. 1 is a longitudinal section view showing the vertical centrifugal separation apparatus according to the embodiment, and FIG. 2 is a front view showing the vertical centrifugal separation apparatus. FIG. 3A is a longitudinal section view showing a bowl, FIG. 4 is a perspective view showing a self-sealing apparatus, and FIG. 5 is a longitudinal section view showing a lower bearing.

As shown in FIGS. 1 and 2, the vertical centrifugal separation apparatus 1 according to the embodiment includes the bowl 2 which is a cylindrical rotational tube placed in a vertical direction, a casing 3 which serves as an exterior body for rotatably accommodating the bowl 2, a driving motor 4 which serves as a driving apparatus for rotating the bowl 2 about a vertical axis in performing centrifugation, and a support apparatus 5 which supports those components.

The casing 3 includes a casing body 31 supported by the support apparatus 5 and an upper casing 32 provided removably on the top of the casing body 31. A temperature adjusting apparatus 33 for performing temperature adjustment in performing centrifugation is placed on an inner wall of the casing body 31. While a cooling coil is placed as an example of the temperature adjusting apparatus 33 in FIG. 1, a heating coil may be used or the temperature adjusting apparatus 33 may be omitted. The casing 3 shown in FIG. 1 has a shape with its inner diameter gradually increased the top as an example, but the shape of the casing 3 is not limited thereto.

The upper casing 32 has the function as a liquid receiving portion which receives a centrifuged liquid discharged from an upper side of the bowl 2 by the action of a centrifugal force in performing centrifugation and guiding the liquid to a recovery nozzle 34. Thus, a gap between the upper casing 32 and the rotation shaft of the bowl 2 is sealed with a sealing member (not shown). The recovery nozzle 34 is removably connected to piping (not shown) for recovery, and the piping for recovery is connected to a reservoir tank for the centrifuged liquid. In pulling the bowl 2 out of the casing 3 or performing maintenance of the apparatus, the upper casing 32 is taken off from the body 31 to open the top of the casing body 31. FIG. 6, later described, shows the apparatus from which the upper casing 32 is taken off.

As shown in detail in FIG. 3A, the bowl 2 has a cylindrical barrel portion 21 having a hollow inside, in which a supply port 22 for a liquid to be processed is formed on a lower side and a discharge port 23 for a centrifuged liquid is formed on an upper side at a position deviated from the rotation axis. A supply nozzle 24 for the liquid to be processed is inserted into a lower-end side of the supply port 22 such that the nozzle 24 is not in contact with an inner wall surface of the bowl 2 to be rotated. An upper-end side of the supply port 22 is communicated with the hollow of the barrel portion 21 through the self-sealing apparatus 6. As described later in detail, the self-sealing apparatus 6 has the function of automatically opening or closing a supply path of the liquid to be processed by the action of the centrifugal force. As apparent from FIG. 3A, the bowl 2 is not provided with a discharge port for centrifuged solid matter. In other words, the vertical centrifugal separation apparatus of the embodiment employs a batch scheme in which the centrifugal liquid which is the target is continuously discharged in performing the centrifugation but the solid matter is discharged by pulling the bowl 2 out of the casing 3. The dimensions and the material of the bowl 2 are not limited, and by way of example, the bowl 2 may have an internal diameter of 95 to 160 mm, a length of 457 to 720 mm, and may be made of stainless steel.

The bowl 2 is removably coupled to a rotation shaft 26*a* of a bearing assembly 26 by a coupling nut 25 serving as a removing means (see FIG. 3A). The bearing assembly 26 is coupled to a rotation pulley 42 of the driving motor 4 via a rotation belt 41 (see FIG. 1). Thus, a screw portion 27 screwed into the coupling nut 25 is formed at an upper end of the rotation shaft of the bowl 2 (see FIG. 3A). As shown in FIG. 1, in performing the centrifugation, the bowl 2 is coupled to the bearing assembly 26, so that the bowl 2 is supported in a suspension state and rotatable about the vertical axis by the power of the driving motor 4. On the other hand, in pulling the bowl 2 out of the casing 3, the coupling by the coupling nut 25 is disengaged to release the coupling state of the bowl 2 and the bearing assembly 26. Then, in the embodiment, a drain cap 7 is connected by using the screw portion 27 (see FIG. 3B).

Figure 3B:
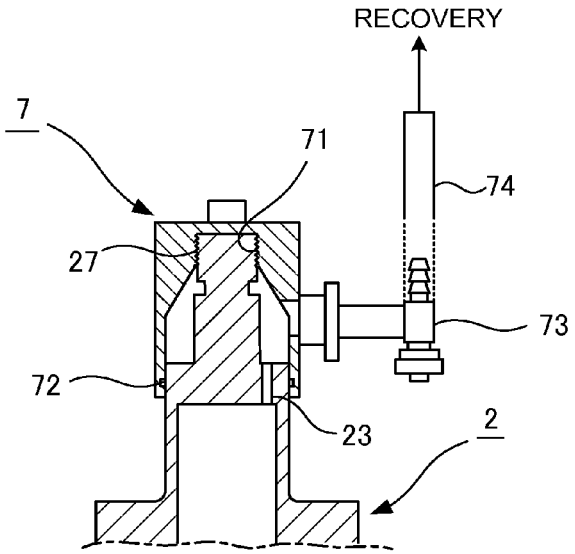
FIG. 3B is a longitudinal section view showing a drain cap which is connected to the bowl.

As shown in FIG. 3B, the drain cap 7 includes a screw portion 71 which engages with the screw portion 27 on the bowl side, an O-ring 72 which serves as a sealing member for ensuring air tightness with a circumferential surface of the bowl 2, and a valve 73 for recovering the remaining liquid in the bowl 2. The drain cap 7 is formed to cap the discharge port 23 for the centrifuged liquid around the port 23. The valve 73 is connected to a tube 74 which serves as a discharge piping. Such a structure prevents the remaining liquid in the bowl 2 from spilling out when the bowl is overturned as described later. However, it is essential only that the drain cap 7 should cap the discharge port 23 for the centrifuged liquid around the port 23 and should have the valve 73 for recovering the remaining liquid in the bowl 2, so that the cap 7 is not limited to the structure shown in FIG. 3B.

Figure 3C:
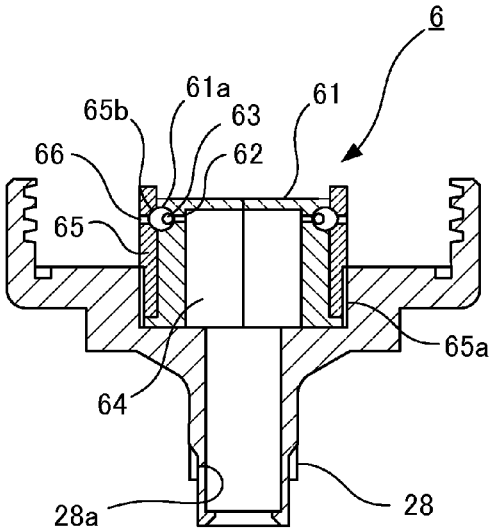
FIG. 3C is a longitudinal section view showing a self-sealing apparatus which is fixed to the bowl.

On the other hand, the self-sealing apparatus 6 has a cup-shaped seal body 61 placed to cover the supply port 22 of the bowl 2 as shown in FIGS. 3A, 3C and 4. The seal body 61 has a groove 61*a* having an arc-shaped section formed on a side circumferential surface, and a plurality of supply holes 62 are formed on the circumference along the groove 61*a*. An O-ring 63, for example made of extensible member such as rubber, is fitted into the groove 61*a* to fill the holes 62 from the outer circumferential side. In an inside area of the seal body 61, a distribution member 64, for example having a cross shape, is placed to distribute the liquid to be processed uniformly among the supply holes 62.

On the other hand, on an outer circumferential side of the seal body 61, a seal nut 65 is placed to fix the seal body 61 having the O-ring 63 and the distribution member 64 mounted thereon to the bowl 2. A screw portion 65*a* is formed on an outer circumferential surface of the seal nut 65 for fixing to the bowl 2. On an inner circumferential surface of the seal nut 65, a groove 65*b* having an arc-shaped section is formed opposite to the groove 61*a* of the seal body 61. A plurality of supply holes 66 are formed on the circumference along the groove 65*b*. The groove 65*b* prevents the O-ring 63 from dropping off and forms space for the O-ring 63 which expands by the action of the centrifugal force.

Specifically, the O-ring 63 made of the extensible member fills the supply holes 62 with its contraction force under normal conditions, but when the bowl 2 is rotated in performing the centrifugation, the O-ring 63 expands outward by the action of the centrifugal force to release the closure of the supply holes 62, and when the rotation of the bowl 2 is stopped, the O-ring 63 again fills the supply holes 62 through its recovery force, thereby performing the self-sealing function. The supply holes 62 are filled immediately after the rotation of the bowl 2 is stopped in this manner to prevent the liquid in the bowl from draining out. Such a self-sealing apparatus 6 of the simple structure using the extensible member is effective, for example when the bowl 2 is rotated at a high speed of 10000 G or more, especially 20000 G.

A sleeve member 28, for example, is fixedly placed on a lower-end side of the rotation shaft of the bowl 2. The sleeve member 28 is fixed to the bowl 2, for example by a screw portion 28*a*. As shown in FIG. 5, a bushing member 81 sliding with the sleeve member 28 is fixedly placed on the casing 3. Reference numeral 82 shows a discharge path for discharging a drain. Specifically, the sleeve member 28 and the bushing member 81 constitute the lower bearing 8 formed of a plain bearing to provide the structure in which the bowl 2 can be pulled out of the casing 3. The sleeve member 28 is made of carbon steel and the bushing member 81 is made of graphite sheet, for example. Reference numeral 83 in FIG. 5 shows a support member which receives the bowl 2 released from the coupling to the bearing assembly 26 when the coupling nut 25 is removed, and reference numeral 84 shows a spring which serves as an elastic member for absorbing the impact.

Returning to FIG. 1, description will be made of the support apparatus 5 which can rotate the casing 3 and the bowl 2 together. The support apparatus 5 has a shaft member 51 which passes through the support apparatus 5 generally horizontally at the level of the center of gravity of the casing 3, for example. The shaft member 51 is rotatably supported about an axis by a bearing means with a bearing member 52. A steering wheel 54 is coupled via a worm gear 53 formed of a worm wheel and a worm, for example. On the other hand, the other end side of the shaft member 51 is integral with or fixed to a side surface of the casing 3 by a fixing means 55. Thus, turning the steering wheel 54 rotates the shaft member 51 about the horizontal axis to allow integral rotation (overturn) of the casing 3 and the bowl 2. To prevent vibrations of the casing 3 and the bowl 2 in performing the centrifugation, releasable fixing means with handle nuts 56 are placed above and below the shaft member 51, for example. In rotating (overturning) the casing 3 and the bowl 2 together, the handle nuts 56 are released to free the fixed state.

In Patent Document 1 described above, the casing can be overturned to the horizontal level (that is, 90 degrees) in order to pull the bowl 2 out of the casing 3. In the embodiment, rotation is possible to a first overturn position (see FIG. 6A) in which the remaining liquid staying in the bowl 2 is recovered after the stop of the centrifugation and to a second overturn position (see FIG. 6B) in which the bowl 2 is pulled out of the casing 3 after the recovery of the remaining liquid. The first overturn position is the position inclined such that the top of the bowl 2 having the discharge port 23 formed therein is lower than at least the horizontal level, for example, a rotated position at an angle Q of 120 degrees or more. The second overturn position is the position rotated to the horizontal level (that is, Q=90 degrees), for example. In this case, a means (pin, for example) for temporal fixing at the first and second overturn positions is preferably provided.

Figure 7A:
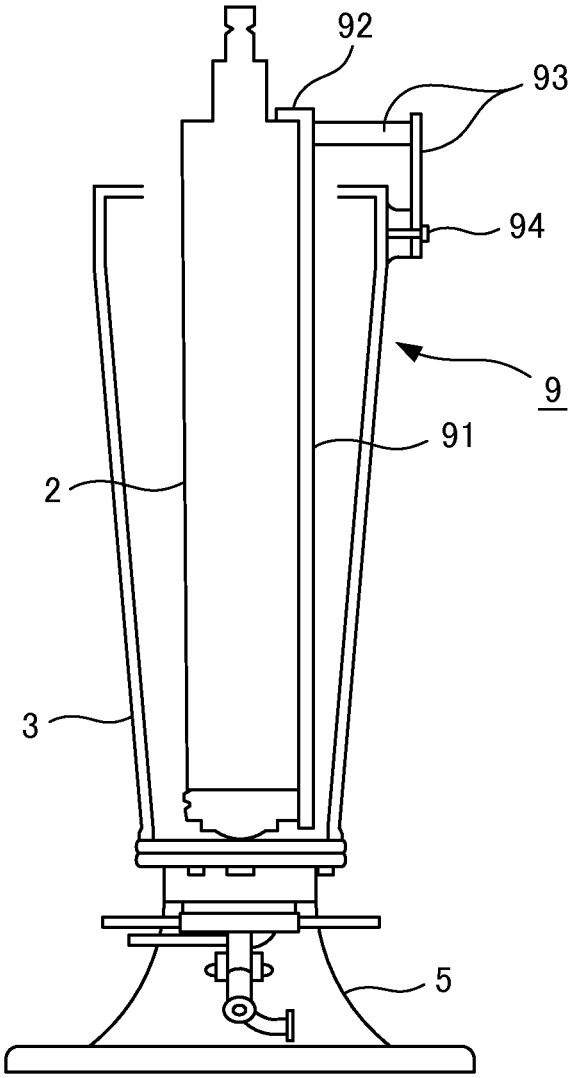
FIG. 7A shows a state in which a support rod assembly, which is an example of a drop prevention apparatus, is mounted on the casing.
Figure 7B:
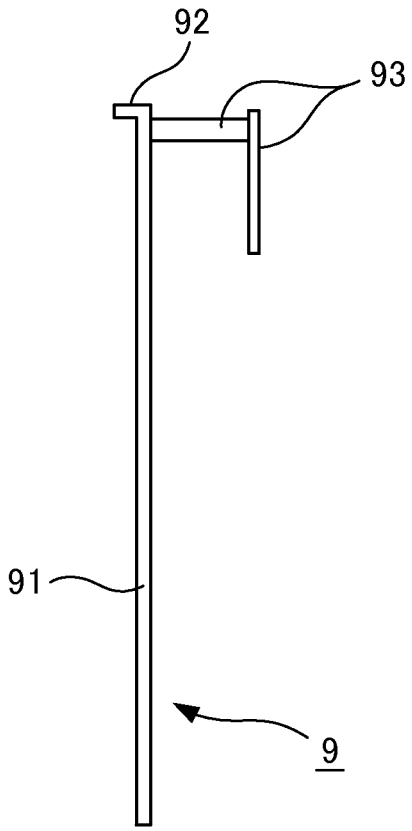
FIG. 7B is a side view showing the support rod assembly.

Next, a drop prevention apparatus supplementally included in the vertical centrifugal separation apparatus of the embodiment will be described with reference to FIGS. 7A and 7B. FIG. 7A shows the state in which a support rod assembly 9, which is an example of the drop prevention apparatus, is mounted on the casing 3. FIG. 7B is a side view showing the support rod assembly 9.

As shown in FIG. 7A, the support rod assembly 9 serving as the drop prevention apparatus has a bowl support plate 91 which has a support surface extending along a length direction of the bowl 2, an L-shaped lock portion 92 which locks a top end of the bowl 2 to prevent dropping thereof, and a fixing support member 93 for fixedly supporting the support rod assembly 9 to the casing 3. For example, after the centrifugation is completed, the coupling state by the coupling nut 25 is released, and the upper casing 32 is removed, the support rod assembly 9 is inserted into the casing 3 and fixed to the casing 3, for example by using a fixing means 94 such as a bolt. The dimensions of the components are set such that the barrel portion of the bowl 2 is in contact with the bowl support plate 91 and the top end of the bowl 2 is locked by the L-shaped lock portion 92.

Description will be made of the procedure for performing the centrifugation and recovering the centrifuged liquid which is the target by using the vertical centrifugal separation apparatus 1 structured as above. While the vertical centrifugal separation apparatus can be used in various industrial fields without limitation, the apparatus is preferably used in fields in which the manufacturing unit price or the cost is likely to be high such as food, drug, medical item, and biotechnology-related fields. Among others, the use in the field of genetic recombination is beneficial. As an application in the field of genetic recombination, it is preferable to centrifuge genetically recombined microbes and a liquid containing a genetically recombined material produced or secreted by the microbes. The genetically recombined microbes include an external secretion type and an internal secretion type. For the former, centrifugation is performed with no additional treatment and then the liquid containing the genetically recombined material is recovered. On the other hand, for the latter, the microbes are crushed and caused to release the genetically recombined material into the liquid before the centrifugation is performed. For example, in the latter case, a genetically recombined drug is provided typically by culturing genetically recombined microbes, concentrating the microbes through the centrifugation, cleaning the microbes, further concentrating the microbes through the centrifugation, breaking the cells thereof, separating the broken cell membranes (cell debris), and sending them to a refining process for performing refining.

First, the state in which the centrifugation can be performed is set as shown in FIG. 1. Then, the bowl 2 is rotated about the vertical axis and the liquid to be processed is supplied into the bowl 2 through the supply nozzle 24. At this point, a lubricating liquid may be supplied to the lower bearing 8 (see FIG. 5). When the liquid to be processed is supplied into the rotating bowl 2, the liquid is separated into solid matter and liquid by the action of the centrifugal force. As the liquid to be processed is continuously supplied, the centrifuged liquid is continuously discharged from the discharge port 23 (see FIG. 3A) with the aid of the action of the centrifugal force and is recovered via the recovery nozzle 34. On the other hand, the solid matter is accumulated in a lower portion of the bowl 2.

When a predetermined time period has elapsed or a predetermined amount of solid matter is accumulated in the bowl 2, the rotation of the bowl 2 is stopped and the supply of the liquid to be processed is stopped. At this point, the self-sealing function described above works to store the liquid in the bowl 2 without draining out.

Figure 6A:
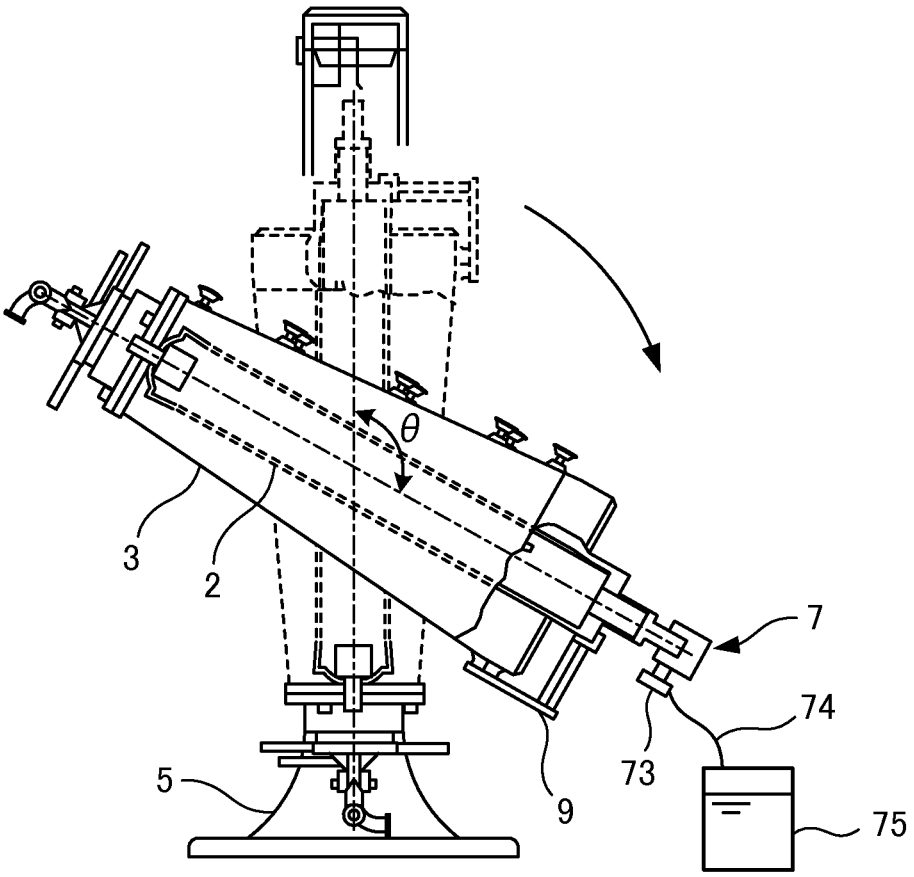
FIG. 6A shows the bowl set to a first overturn position in which the remaining liquid staying in the bowl is recovered after the stopping of centrifugation.
Figure 6B:
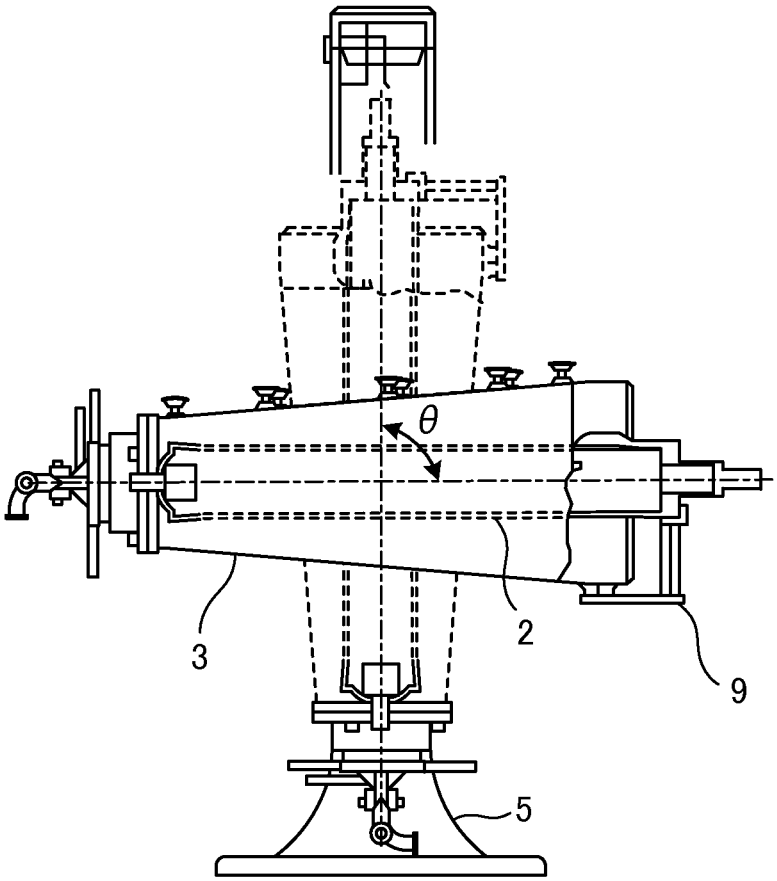
FIG. 6B shows the bowl set to a second overturn position in which the bowl is pulled out of a casing after the recovery of the remaining liquid.

Then, the operation of recovering the liquid (remaining liquid) in the bowl 2 is performed. First, the upper casing 3 is removed, the coupling nut 25 is removed, and the drain cap 7 (see FIG. 3B) is placed. Next, the support rod assembly 9 is mounted as shown in FIG. 7A. Then, the handle nuts 56 are removed and the steering wheel 54 is turned to rotate (overturn) the casing 3 and the bowl 2 to the first overturn position. As shown in FIG. 6A, the recovery tube 74 is connected to the valve 73, and the valve 73 is opened to recover the remaining liquid in a recovery container 75.

When the recovery of the remaining liquid is completed, the recovery tube 74 is removed from the valve 73 and the steering wheel 54 is turned to set the second overturn position. Then, the bowl 2 is lifted until the end (upper side) of the bowl 2 is beyond the L-shaped lock portion 92, and the bowl 2 is slid generally horizontally and pulled out of the casing 3. Then, the bowl 2 is transported by a carrier or the like, not shown, and then discharge of the solid matter and cleaning are performed.

As described above, the vertical centrifugal separation apparatus according to the embodiment is formed such that the centrifuged liquid is continuously recovered from the upper portion of the rotating bowl 2 in performing the centrifugation, and when the centrifugation is stopped, the bowl 2 is set at the first overturn position to recover the remaining centrifuged liquid and then the bowl 2 is set at the second overturn position to allow the removal of the bowl 2 from the casing 3. Thus, the liquid remaining in the bowl 2 does not represent a loss each time the bowl 2 is pulled out of the casing 3, and the centrifuged liquid as the target can be recovered with no waste.

Since the vertical centrifugal separation apparatus according to the embodiment can prevent occurrence of a loss in the recovery in this manner, the centrifuged liquid having a very high manufacturing unit price or cost can be recovered as much as possible in the food, drug, medical item, biotechnology-related fields, for example. Especially, in the field of genetic recombination in which various development works have been actively performed in recent years, the manufacturing unit price of the liquid tends to be extremely high, so that recovery of the liquid as much as possible, not wasting even a drop, is an effective means.

In addition, since the vertical centrifugal separation apparatus according to the embodiment realizes the drop prevention apparatus with the support rod assembly 9 of the simple structure, it is possible to prevent an increase in price of the apparatus caused by automation and to perform the recovery of the remaining liquid and the removal of the bowl 2 with a relatively slight burden on an operator.

Furthermore, since the vertical centrifugal separation apparatus according to the embodiment includes the self-sealing apparatus 6 which opens supply holes 62 (see FIG. 3C) by the action of the centrifugal force and fills the supply holes 62 by the self-action immediately after the rotation of the bowl 2 is stopped, it is possible to prevent the remaining liquid from draining out to enhance the recovery efficiency. To allow the removal of the bowl 2, the vertical centrifugal separation apparatus according to the embodiment has the lower bearing 8 formed of the plain bearing as shown in FIG. 5. Thus, if the remaining liquid drains out, shaving residues of the sleeve member 28 or the bushing member 81 and the like are mixed to make the apparatus unusable as a product. Under such circumstances, the self-sealing apparatus 6 which is placed between the lower bearing 8 and the bowl 2 capable of preventing the remaining liquid from draining out to enhance the recovery efficiency is an extremely effective means.

Figure 8:
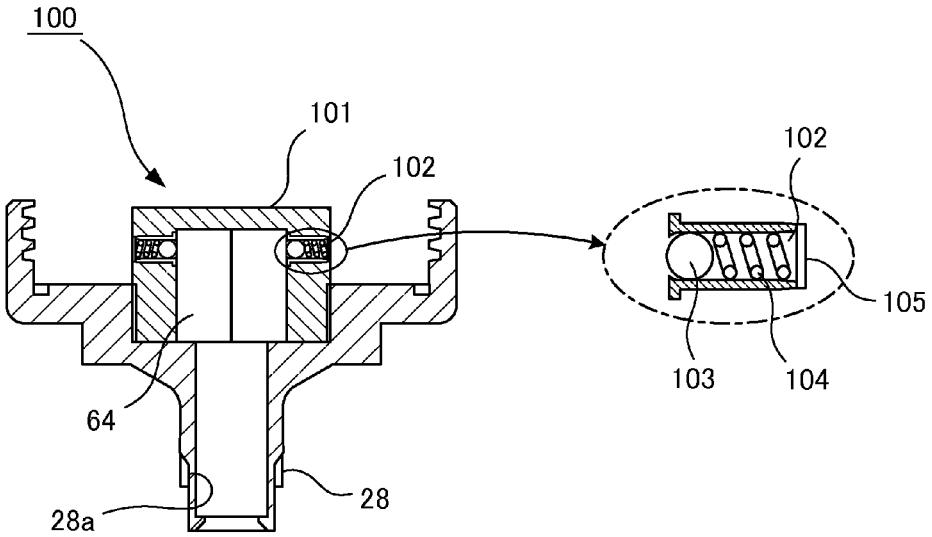
FIG. 8 is a modification of the self-sealing apparatus.

Next, another structure example of the self-sealing apparatus will be described with reference to FIG. 8. Specifically, as shown in FIG. 8, a self-sealing apparatus 100 has a plurality of supply holes 102 which are formed in a side surface of a seal body 101 and a ball 103 which serves as a spherical filling member and is placed in the supply holes 102, for example. The ball 103 is urged by a spring 104, for example, to fill the supply holes 102. When a bowl 2 is rotated in performing centrifugation, the action of the centrifugal force moves the ball 103 outward against the urging force of the spring 104 to open the supply holes 102. In addition, the diameter of the supply hole 102 on an inner circumferential surface side is formed to be smaller than the diameter of the ball 103, and a stopper 105 having a ring-shaped plan face is placed on an outer circumferential surface side, thereby preventing the ball 103 from falling off.

While the present invention has been described in detail according to the specific embodiment, it is apparent to those skilled in the art that various substitutions, modifications, variations and the like of the forms or details may be performed without departing from the sprit or scope of the present invention as defined by the claims. Therefore, the scope of the present invention is not limited to the abovementioned embodiment and the accompanying drawings but should be defined on the basis of the claims and the equivalent.

The invention claimed is:

1. A vertical centrifugal separation apparatus comprising:

a cylindrical rotational tube which has a supply port for a liquid to be processed formed on a lower side, has a discharge port for a centrifuged liquid formed on an upper side, and is rotated about a vertical axis in performing centrifugation;

a casing which accommodates the cylindrical rotational tube such that the tube is rotatable about the vertical axis;

a support apparatus which supports the casing and the cylindrical rotational tube such that the casing and the tube are overturned together; and a self-sealing apparatus having a supply hole for the liquid to be processed and a close member which covers the supply hole from the outside to close the supply hole, the supply hole being provided in a circumferential direction in a lower portion of the cylindrical rotational tube and passing through the cylindrical rotational tube in a diameter direction, wherein the support apparatus can be set to a first overturn position in which a centrifuged liquid remaining in the cylindrical rotational tube is recovered after the centrifugation is completed and a second overturn position in which the cylindrical rotational tube is pulled out of the casing after the remaining centrifuged liquid is recovered, wherein the close member expands or moves outward to open the supply hole by the action of a centrifugal force when the cylindrical rotational tube is rotated in performing the centrifugation, and the close member closes the supply hole when the rotation of the cylindrical rotational tube is stopped.

2. The vertical centrifugal separation apparatus according to claim 1, further comprising a drop prevention apparatus which fixes an upper portion of the cylindrical rotational tube and the casing at least when the first overturn position is set.

3. The vertical centrifugal separation apparatus according to claim 2, wherein the drop prevention apparatus includes:

a barrel portion support member which has a support surface supporting a barrel portion of the cylindrical rotational tube set to the overturn position in the casing and sliding the barrel portion of the cylindrical rotational tube pulled out of the casing; and an L-shaped lock portion which is formed in an end portion of the barrel portion support member and locks an upper end surface of the cylindrical rotational tube.

4. The vertical centrifugal separation apparatus according to claim 1, wherein the first overturn position is a position inclined such that the upper portion of the cylindrical rotational tube is lower than at least a horizontal level.

5. The vertical centrifugal separation apparatus according to claim 4, wherein the first overturn position is a position at which the cylindrical rotational tube is rotated at least 120 degrees.

6. The vertical centrifugal separation apparatus according to claim 1, wherein the vertical centrifugal separation apparatus is not provided with a discharge port for discharging solid matter in performing the centrifugation, and a target of the centrifugation is the centrifuged liquid separated by the centrifugation.

7. The vertical centrifugal separation apparatus according to claim 1, wherein the liquid to be processed contains a genetically recombined microbe and a genetically recombined material produced or secreted by the microbe.

* * * * *